US008686327B2

(12) United States Patent
Yacobovitch

(10) Patent No.: US 8,686,327 B2
(45) Date of Patent: Apr. 1, 2014

(54) MISSILE NOSE FAIRING SYSTEM

(75) Inventor: Yacov Yacobovitch, Kiryat Motzkin (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 86 days.

(21) Appl. No.: 13/500,569

(22) PCT Filed: Oct. 14, 2010

(86) PCT No.: PCT/IL2010/000840

§ 371 (c)(1),
(2), (4) Date: Jul. 11, 2012

(87) PCT Pub. No.: WO2011/045792

PCT Pub. Date: Apr. 21, 2011

(65) Prior Publication Data

US 2012/0267471 A1 Oct. 25, 2012

(30) Foreign Application Priority Data

Oct. 15, 2009 (IL) ..... 201585

(51) Int. Cl.
*F42B 15/01* (2006.01)

(52) U.S. Cl.
USPC ..... 244/3.24; 244/130

(58) Field of Classification Search
USPC ..... 244/3.24, 3.26, 3.27, 121, 130; 342/62; 343/872
See application file for complete search history.

(56) References Cited

U.S. PATENT DOCUMENTS

| | | | | |
|---|---|---|---|---|
| 3,412,962 | A | 11/1968 | Killian | |
| 3,601,055 | A | 8/1971 | Crockett | |
| 4,411,399 | A | 10/1983 | Hapke | |
| 4,944,226 | A | 7/1990 | Wedertz et al. | |
| 5,404,814 | A | 4/1995 | Fisch et al. | |
| 5,436,630 | A * | 7/1995 | Nash | 342/2 |
| 5,464,172 | A | 11/1995 | Jensen et al. | |
| 5,494,239 | A | 2/1996 | Giacomel | |
| 6,834,835 | B1 | 12/2004 | Knowles et al. | |
| 7,082,878 | B2 | 8/2006 | Facciano et al. | |
| 7,093,799 | B1 | 8/2006 | Dulat et al. | |

OTHER PUBLICATIONS

International Search Report for corresponding International Patent Application No. PCT/IL2010/000840 mailed Mar. 11, 2011.

* cited by examiner

*Primary Examiner* — Timothy D Collins
*Assistant Examiner* — Nicholas McFall
(74) *Attorney, Agent, or Firm* — Merchant & Gould P.C.

(57) ABSTRACT

A missile nose fairing system includes sections attached at an aft end thereof to a missile body, a restraint for normally preventing aftward displacement of the plurality of sections, and a drive unit for releasing the restraint in response to a received signal. Each of the sections has an outer surface that converges to a common forward pointed tip for enclosing and protecting a guidance head when in an extended position and is retractable into a corresponding recessed region formed within a missile nose when the drive unit is activated releasing the restraint.

22 Claims, 9 Drawing Sheets

MISSILE NOSE FAIRING SYSTEM

This application is a National Stage Application of PCT/IL2010/000840, filed 14 Oct. 2010, which claims benefit of Serial No. 201585, filed 15 Oct. 2009 in Israel and which applications are incorporated herein by reference. To the extent appropriate, a claim of priority is made to each of the above disclosed applications.

FIELD OF THE INVENTION

The present invention relates to the field of fairing assemblies. More particularly, the invention relates to a missile nose fairing system.

BACKGROUND OF THE INVENTION

Prior art nose fairing assemblies for providing heat and drag reduction for the nose of a missile, and particularly for the electro-optic guidance head housed therein, have been designed to be released from the missile body so that the guidance head will be unobstructed in the vicinity of the target. Debris resulting from the separation of the fairing assembly from the missile body is liable to damage the guidance head or other components of the missile.

It is an object of the present invention to provide a missile nose fairing system which is adapted to reveal the guidance head in the vicinity of a target, yet the fairing assembly is inseparable from the body of the missile.

It is an additional object of the present invention to provide a simply operating nose fairing system.

It is an additional object of the present invention to provide a controllable and reliable nose fairing system.

Other objects and advantages of the invention will become apparent as the description proceeds.

SUMMARY OF THE INVENTION

The present invention provides a missile nose fairing system, comprising:

a) a plurality of sections attached at an aft end thereof to a missile body, each of said sections having an outer surface that converges to a common forward pointed tip for enclosing and protecting a guidance head, e.g. an electro-optic guidance head, when in an extended position and being retractable into a corresponding recessed region formed within a missile nose;

b) restraining means for normally preventing aftward displacement of said plurality of sections; and c) a drive unit for releasing said restraining means in response to a received signal, thereby allowing said plurality of section to be retracted into the corresponding recessed regions.

The cross section of each section is preferably an arc surrounding the longitudinal axis of the missile nose, the arc length of each section gradually decreasing from an aft edge of the section to the tip thereof. Each recessed region is similarly configured as a corresponding section, an inner surface of a retracting section being slidable along an outer surface of a corresponding recessed region.

In one aspect, each section is triangularly shaped. Each section has two substantially parallel side edges extending from the aft edge and two converging side edges extending from said parallel edges, respectively, to the tip, a triangular opening being formed between the aft edge of two adjacent sections set in an extended position and leads to a junction between the adjacent converging side edges of said two adjacent sections.

In one aspect, a plurality of recessed regions are formed in a surface of a missile nose assembly in which the guidance head is housed, said nose assembly comprising an annular aftwardly disposed base portion connected to the missile body and a forwardly disposed guide portion provided with the plurality of recessed regions, the aft edge of each of the sections in a completely retracted position adapted to abut a forward surface of the base portion.

In one aspect, the guide portion comprises a plurality of identical circumferentially spaced and triangularly shaped dividers provided along an outer surface of the guide portion and extending forwardly from the base portion, and a surface which is recessed from said dividers and which extends from the base portion to a forward edge of the nose assembly being spaced forwardly from an apex of each of said dividers.

In one aspect, a recessed region for receiving a corresponding retracting section is defined between a pair of adjacent dividers, and a circumferential distance along the recessed surface of each region between a first side edge of a first divider and a second side edge of a second divider which is adjacent to said first divider is substantially equal to the circumferential distance between the substantially parallel side edges of a section received in a corresponding recessed region.

In one aspect, the nose assembly tapers such that the diameter of its forward edge is less than that of the base portion, the degree of tapering of the nose assembly being substantially equal to the degree of tapering of each retractable section.

In one aspect, each section is attached to the missile body by means of one or more tension springs which are biased to draw the section aftwardly upon release of the restraining means.

In one embodiment of the invention, the restraining means comprises a longitudinally fixed and a transversally deformable ring configured such that the plurality of sections are allowed to be aftwardly displaced upon deformation of said ring. The ring is formed with a seat for receiving a displaceable restraining pin arranged such that deformation of the ring is prevented when said restraining pin is received in said seat. The restraining pin is associated with the drive unit which, when actuated, releases the pin from the seat, thereby allowing the ring to become deformed.

In one aspect, the ring comprises two pivotable circumferential portions arranged such that the forward face of said two circumferential portions abuts the aft edge of each section in an extended position and ceases to abut the aft edge of each section following actuation of the drive unit and the pivotal displacement of said two circumferential portions.

In one aspect, the ring comprises two parallel and concentric annular plates that define a groove therebetween arranged such that an end of a first circumferential portion is received in the groove of a second circumferential portion upon pivotal displacement of said first and second circumferential portions.

In one aspect, the ring is compressible and made of a springy metal. Each section in an extended position applies a radially inwardly directed force onto the ring so that, when the restraining pin is removed from the seat, portions of the ring are inwardly displaced and the sections are allowed to be aftwardly displaced.

In one aspect, the ring is longitudinally fixed within a transversal channel formed in the missile nose assembly and extending between a recessed region and the guidance head, the width of said channel being substantially equal to the thickness of the ring.

In one aspect, the drive unit has an actuator in communication with a controller, said controller adapted to activate said actuator in response to a transmitted signal. The actuator is selected from the group consisting of electric, electronic, pneumatic, or pyrotechnic means.

In one aspect, the drive unit comprises a cylinder fixedly attached to missile body and the restraining pin is axially displaceable within the interior of said cylinder.

DETAILED DESCRIPTION OF PREFERRED EMBODIMENTS

The present invention is a novel nose fairing system for missiles. In contrast to prior art nose fairing assemblies which separate from the missile body in the vicinity of the target to allow the guidance head to be unobstructed, resulting in debris that is liable to damage the guidance head or other components of the missile, the nose fairing system of the present invention comprises a plurality of retractable sections. The sections, which are normally restrained, are retracted into corresponding recessed regions formed within the missile nose, in response to a received signal which initiates operation of an actuator for releasing the restraining means. As the retractable sections remain attached to the missile body while both in an extended position and in a retracted position, damage to valuable components of the missile, including the guidance head which is housed within the missile nose, is prevented.

Figure 1:
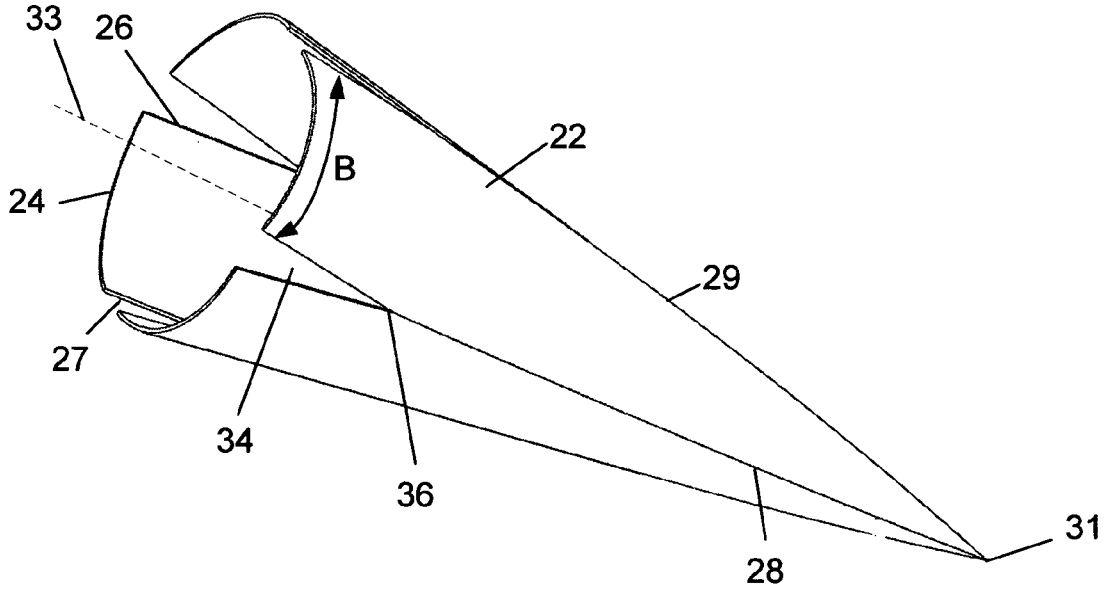
FIG. 1 is a perspective view of a plurality of retractable sections in an extended position according to one embodiment of the present invention, shown without the missile nose assembly.

FIG. 1 illustrates, according to one embodiment of the present invention, four sections 22, which may be identical and are shown in an extended position while the missile nose assembly is removed for clarity. Each section 22 is convex and triangularly shaped, being provided with a relatively wide aft edge 24, two substantially parallel side edges 26 and 27 extending from aft edge 24, and two converging side edges 28 and 29 extending from parallel edges 26 and 27, respectively, to a common forward pointed tip 31. A triangular opening 34 is formed between the aft edge 24 of two adjacent sections 22 set in an extended position. Triangular opening 34 leads to a junction 36 between the adjacent converging side edges of two sections 22. The cross section of each section 22 is an arc surrounding longitudinal axis 33 of the missile nose, the arc length gradually decreasing from aft edge 24 to tip 31. The aft edge 24 of each of the plurality of sections 22 may trace a circle concentric with longitudinal axis 33.

Figure 2:
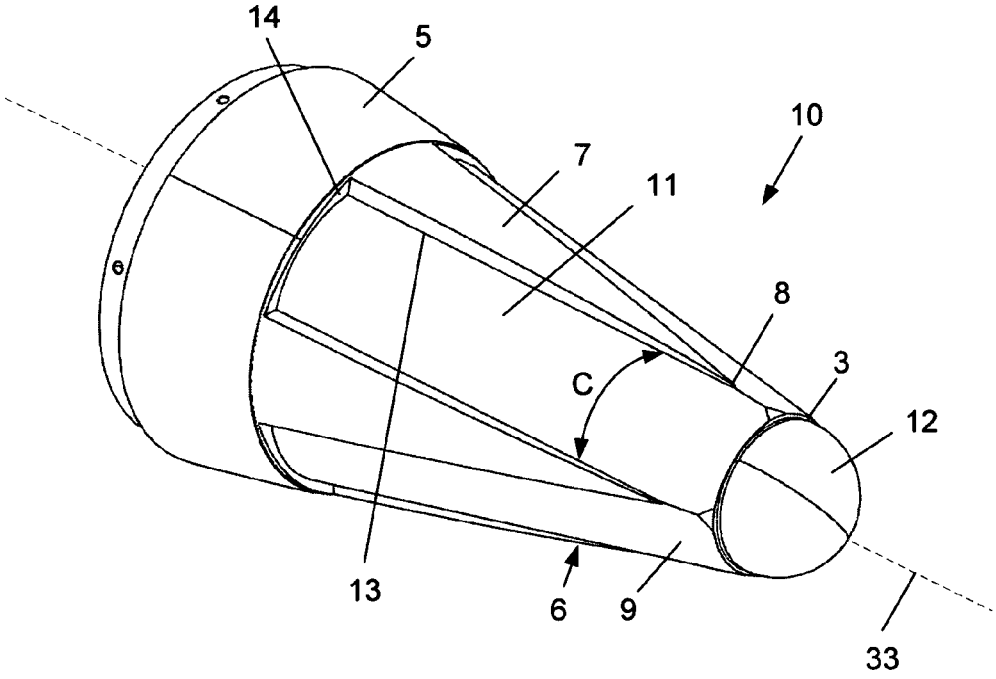
FIG. 2 is a perspective view of a missile nose assembly according to one embodiment of the present invention, shown without the aerodynamic sheathing.

In order to accommodate and guide the sections as they are being retracted, missile nose assembly 10 illustrated in FIG. 2 is employed. Annular nose assembly 10, which is shown without the aerodynamic sheathing for clarity, has an aftwardly disposed base portion 5 connected to the missile body and a forwardly disposed guide portion 6. Guide portion 6 comprises four identical circumferentially spaced and triangularly shaped dividers 7 at the outer surface of guide portion 6 and extending forwardly from base portion 5, and a surface 9 that is recessed from dividers 7 from base portion 5 to forward edge 3, which is spaced forwardly from apex 8 of dividers 7. A rectangular recessed region 11 for receiving a corresponding section after the restraining means is released, as will be described hereinafter, is defined between each pair of adjacent triangular dividers 7, exposing a circumferential abutting surface 14 at the forward edge of base portion 5. The circumferential distance C along recessed surface 9 between adjacent side edges 13 of dividers 7 is substantially equal to the circumferential distance B between side edges 26 and 27 of a section 22 (FIG. 1).

Each of base portion 5, dividers 7, and recessed surface 9 trace a closed curve that surrounds longitudinal axis 33 of the missile nose. The width of nose assembly 10, e.g. its outer diameter, decreases in a forward direction, gradually tapering from base portion 5 to forward edge 3. The degree of tapering of nose assembly 10 is substantially equal to the degree of tapering of each retractable section 22 (FIG. 1). Guidance head 12, e.g. an electro-optic guidance head, is housed within nose assembly 10 and coincides with forward edge 3 of nose assembly 10.

Figure 3:
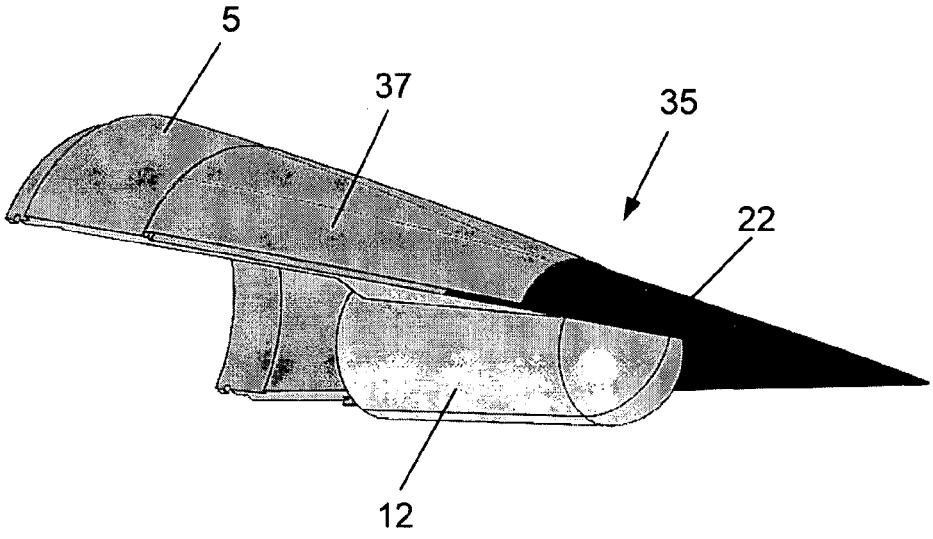
FIG. 3 is a perspective view of a portion of an assembled missile nose, shown without the guide portion of the nose assembly.

FIG. 3 illustrates a portion of an assembled missile nose 35 while the guide portion of the nose assembly has been removed for clarity. Annular aerodynamic sheathing 37 is shown to extend forwardly from base portion 5 of the assembly and to cover a portion of the retractable sections 22. When the sections 22 are in an extended position as shown, they enclose and protect guidance head 12.

Figure 4:
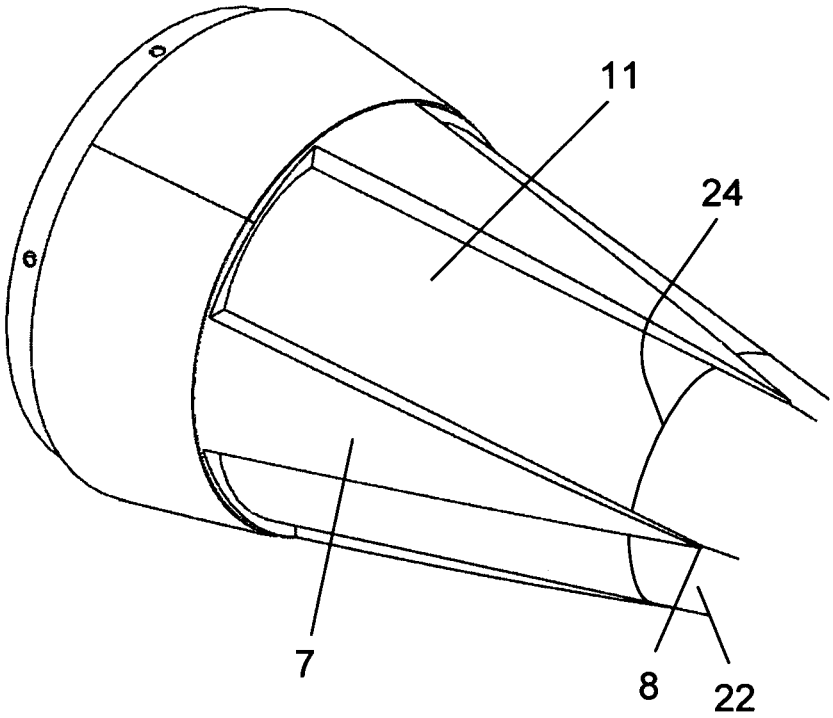
FIG. 4 is a perspective view of a plurality of sections in an extended position, showing the aft edge of each section in contact with the surface of a corresponding recessed region.

In FIG. 4, the sections 22 are shown in the extended position while apex 8 of each triangular divider 7 delimiting two adjacent recessed regions 11 is received in the triangular opening between, and abuts the junction of, two adjacent sections 22. Aft edge 24 of each section 22 is disposed aftwardly from the apexes 8 and contacts the surface of a corresponding recessed region 11.

Figure 5:
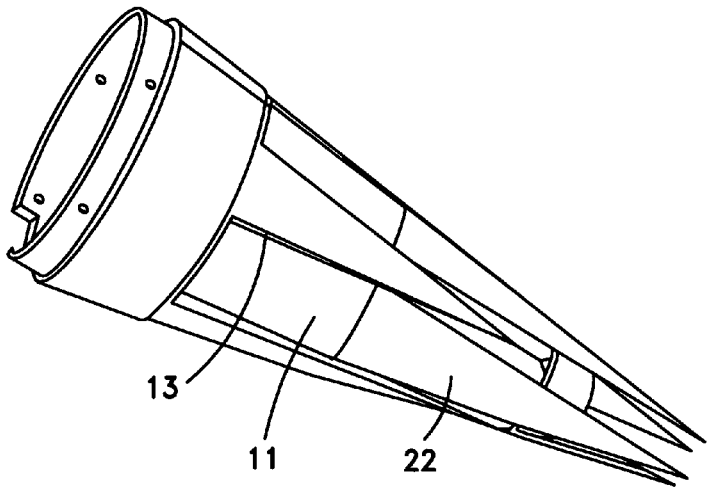
FIG. 5 is a perspective view of a plurality of sections in an intermediate position.

FIG. 5 illustrates the sections 22 while they are retracted to an intermediate position. While the sections 22 are being retracted, their inner surface, i.e. the surface facing the nose assembly, slides along the similarly configured surface of the corresponding recessed regions 11 while side edges 26 and 27 of a section 22 (FIG. 1) contact the corresponding side edges 13 of the recessed region.

Figure 6:
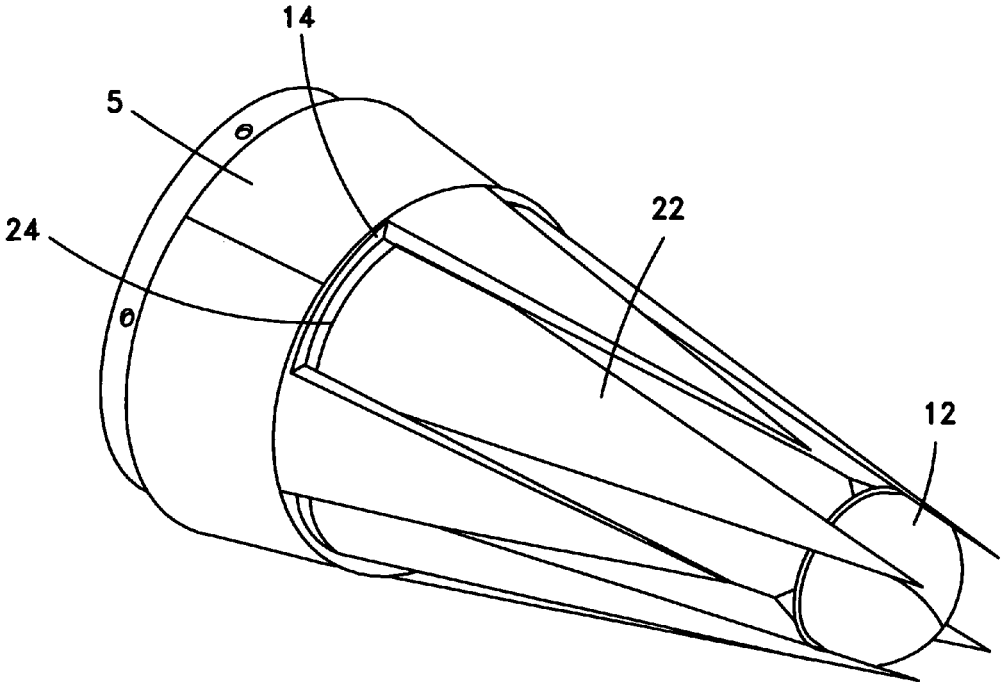
FIG. 6 is a perspective view of a plurality of sections in a substantially retracted position.

In FIG. 6, the sections 22 are set to a retracted position at which guidance head 12 is substantially unobstructed. When a section 22 is displaced to a completely retracted position, its aft edge 24 contacts abutting surface 14 of base portion 5.

Figure 7:
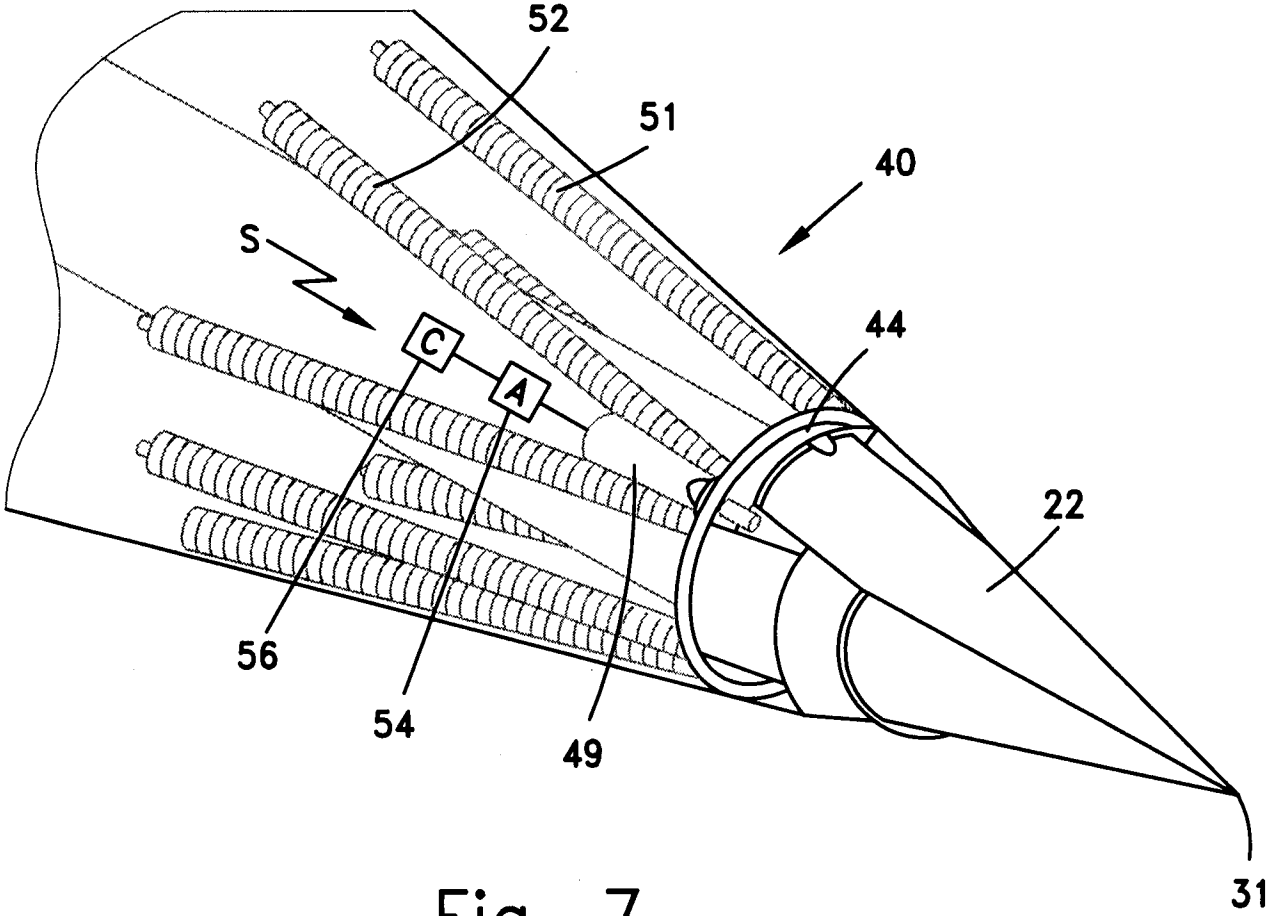
FIG. 7 is a perspective view of a missile nose fairing system according to one embodiment of the present invention.

FIG. 7 illustrates a nose fairing system 40, according to one embodiment of the present invention. In addition to the plurality of retractable sections 22 that converge to a common tip 31 when in the extended position, fairing system 40 comprises a ring 44 for restraining aftward displacement of the sections 22, a drive unit 49 for releasing the engagement of ring 44 with the sections 22, and two tension springs 51 and 52, or any desired number, which are attached to a corresponding section 22 and are biased to draw the corresponding section aftwardly. Drive unit 49 has an actuator 54 in communication with a controller 56, which when activated in response to a transmitted signal S, causes ring 44 to be disengaged from the sections 22, thereby allowing the plurality of sections to be retracted. One end of the tension springs may be attached to the inner side of a section 22, i.e. the side facing the missile nose assembly, and a second end thereof may be anchored to the missile body. The tension springs may pass through a corresponding aperture formed in abutting surface 14 of base portion 5 (FIG. 2).

Figure 8:
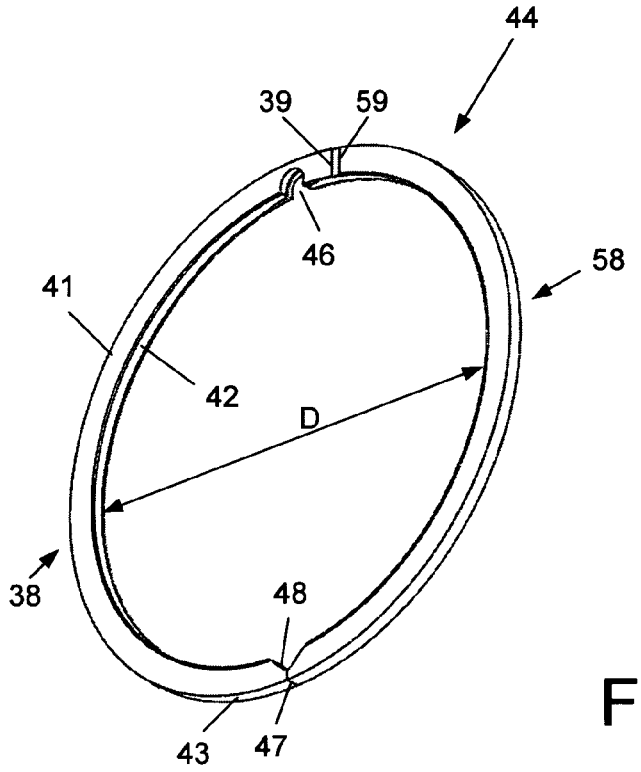
FIG. 8 is a perspective view of a ring for restraining the displacement of the plurality of sections of FIG. 1, according to one embodiment of the present invention.

Ring 44 is illustrated in FIG. 8, and comprises two annular plates 41 and 42 connected by outer surface 43 and defining a groove therebetween. The plates are formed with a seat 46, e.g. an arcuate seat, for receiving a displaceable restraining pin, which is removed for clarity and will be described hereinafter, and with pivoting means 47, e.g. a pivot connecting the two plates 41 and 42, or a weakened portion 48. Ring 44 may be non-continuous, being provided with a first circumferential portion 38 extending from end 39 to pivoting means 47 and with a second circumferential portion 58 extending from end 59, which is separate from end 39, to pivoting means 47. The thickness of portion 58 may be less than that of portion 38, to allow the former to be received in the groove formed in portion 38. When the restraining pin is received in seat 46, inward displacement I (FIG. 9), i.e. in a circumferential direction towards seat 46, of portion 58 with respect to portion 38 is prevented and the inner diameter of ring 44 is D.

Figure 9:
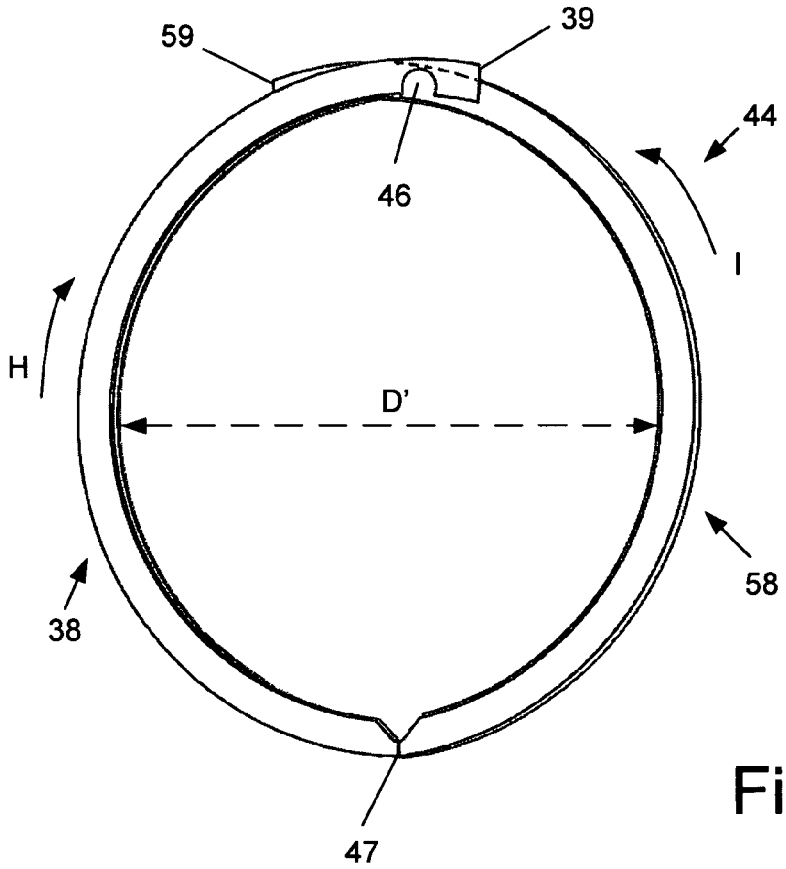
FIG. 9 is a front view of the ring of FIG. 8, showing an exemplary change in configuration following removal of a restraining pin therefrom.

FIG. 9 illustrates the change in configuration of ring 44 after the restraining pin has been removed. Following removal of the restraining pin, both portions 38 and 58 pivot about pivoting means 47, portion 38 pivoting in direction H and portion 58 pivoting in direction I which is rotationally opposite to direction H. While being inwardly displaced, end 59 of portion 58 is received in the groove of portion 38 such that seat 46 is interposed between end 39 of portion 38 and end 59 of portion 58. After portion 58 has been inwardly displaced, the minor axis of ring 44 is reduced to D'.

Ring 44 may be configured such that the aft edge of each section in an extended position is in abutting relation with the forward face of the ring, when inward displacement of portion 58 is prevented. The plane defined by the forward face of the ring need not be perpendicular to longitudinal axis 33 of the missile nose (FIGS. 1 and 2). Following pivotal displacement of portions 38 and 58 in directions H and I, respectively, the forward face of the ring ceases to abut the aft edge of each section. Since ring 44 no longer restrains the plurality of sections, the tension springs are able to draw each corresponding section aftwardly.

Figure 10:
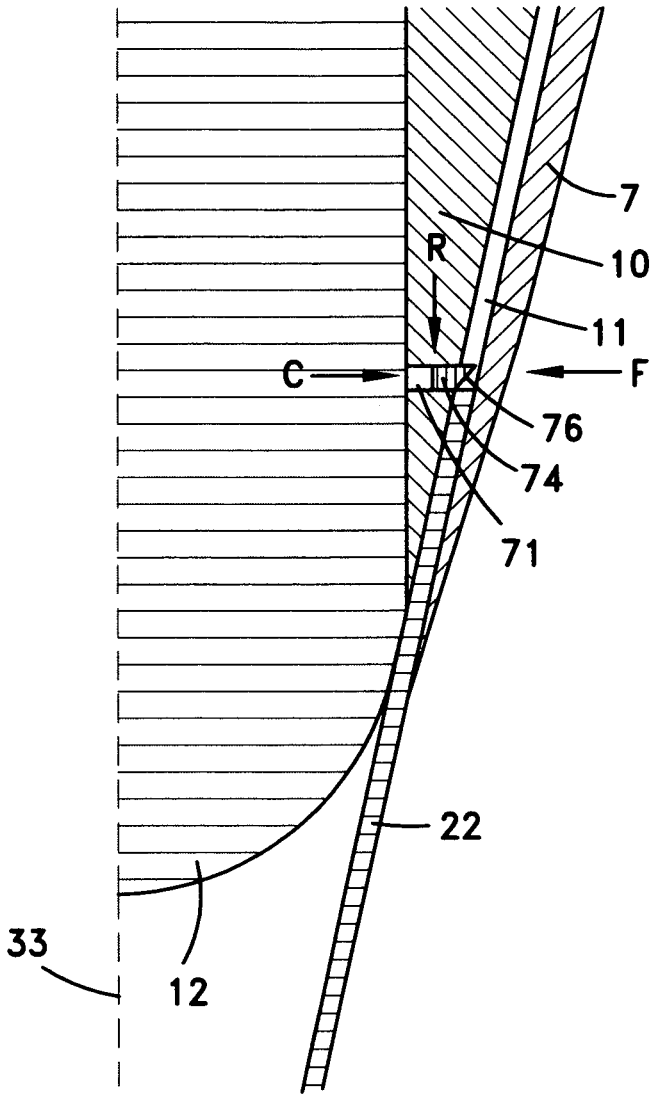
FIG. 10 is a longitudinal section of a portion of the missile nose fairing system of FIG. 7, showing a section in an extended position.
Figure 11:
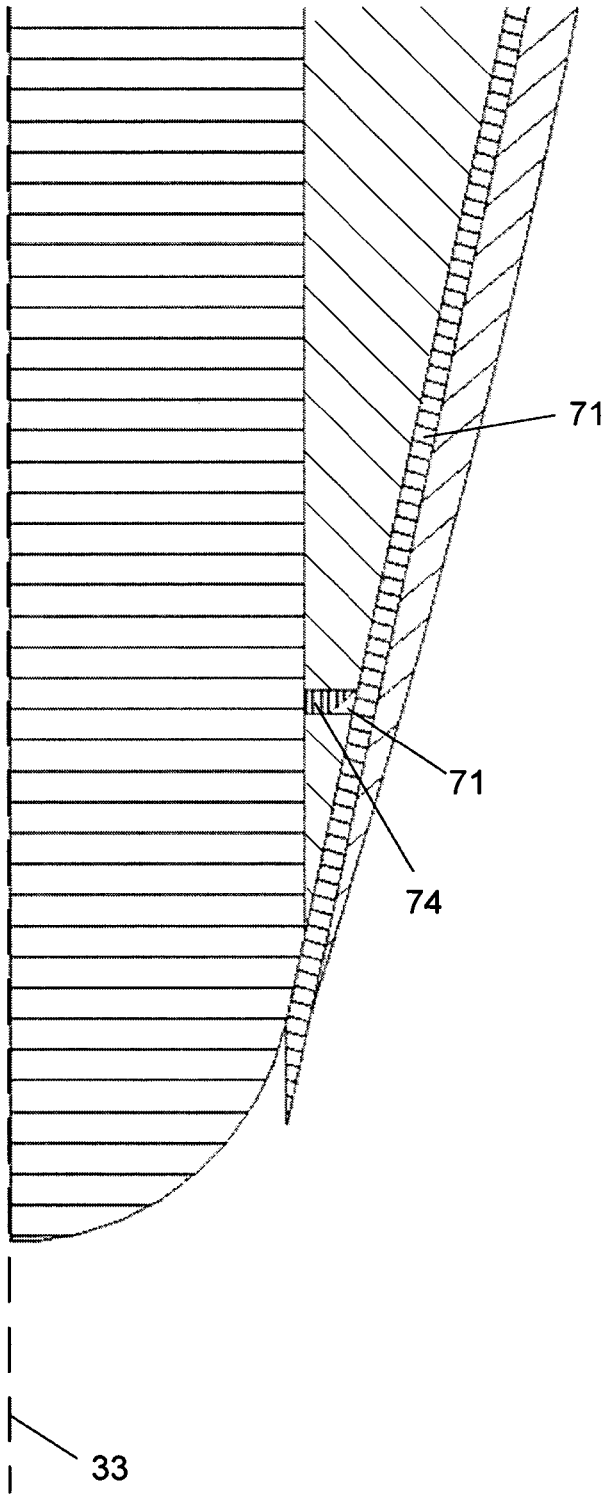
FIG. 11 is a longitudinal section of a portion of the missile nose fairing system of FIG. 7, showing a section in a retracted position.

FIGS. 10 and 11 illustrate the contribution of the ring in normally preventing aftward displacement of the sections and in enabling aftward displacement thereof following transmission of a signal S from a control system to controller 56 (FIG. 7) in the vicinity of the target, to allow guidance head 12 to be unobstructed and to perform a guiding operation.

As shown in FIG. 10, the inner side of a section 22 abuts outer surface 76 of a ring 74, only a portion of which being illustrated in the sectional view, in such a way that it applies a radially inwardly directed force F onto the ring. The restraining pin engaged with the seat formed in ring 76 provides a radially outwardly directed force C which counteracts force F, to prevent inward displacement of the ring. Ring 74 in turn applies a longitudinally directed reactive force R to section 22 as it is positioned in a transversal channel 71 formed in missile nose assembly 10, extending between recessed region 11 and guidance head 12. The width of channel 71 is substantially equal to the thickness of ring 76, so that the ring, which is configured to occupy a portion of the volume of a recessed region 11, is longitudinally fixed and will therefore prevent aftward displacement of a section 22 in contact therewith towards a corresponding recessed region 11. Ring 74 may be continuous and be made of a springy metal, e.g. PH15-5.

FIG. 11 illustrates the radially inward displacement of ring 74 within channel 71. Following removal of the restraining pin from the seat of ring 74, ring 74 becomes compressed as a result of the radially inwardly directed force F applied by the plurality of sections 22 and is urged radially inwardly within channel 71. Since sections 22 are no longer restrained by ring 74, they are aftwardly displaced by means of the tension springs within the corresponding recessed regions.

Figure 12:
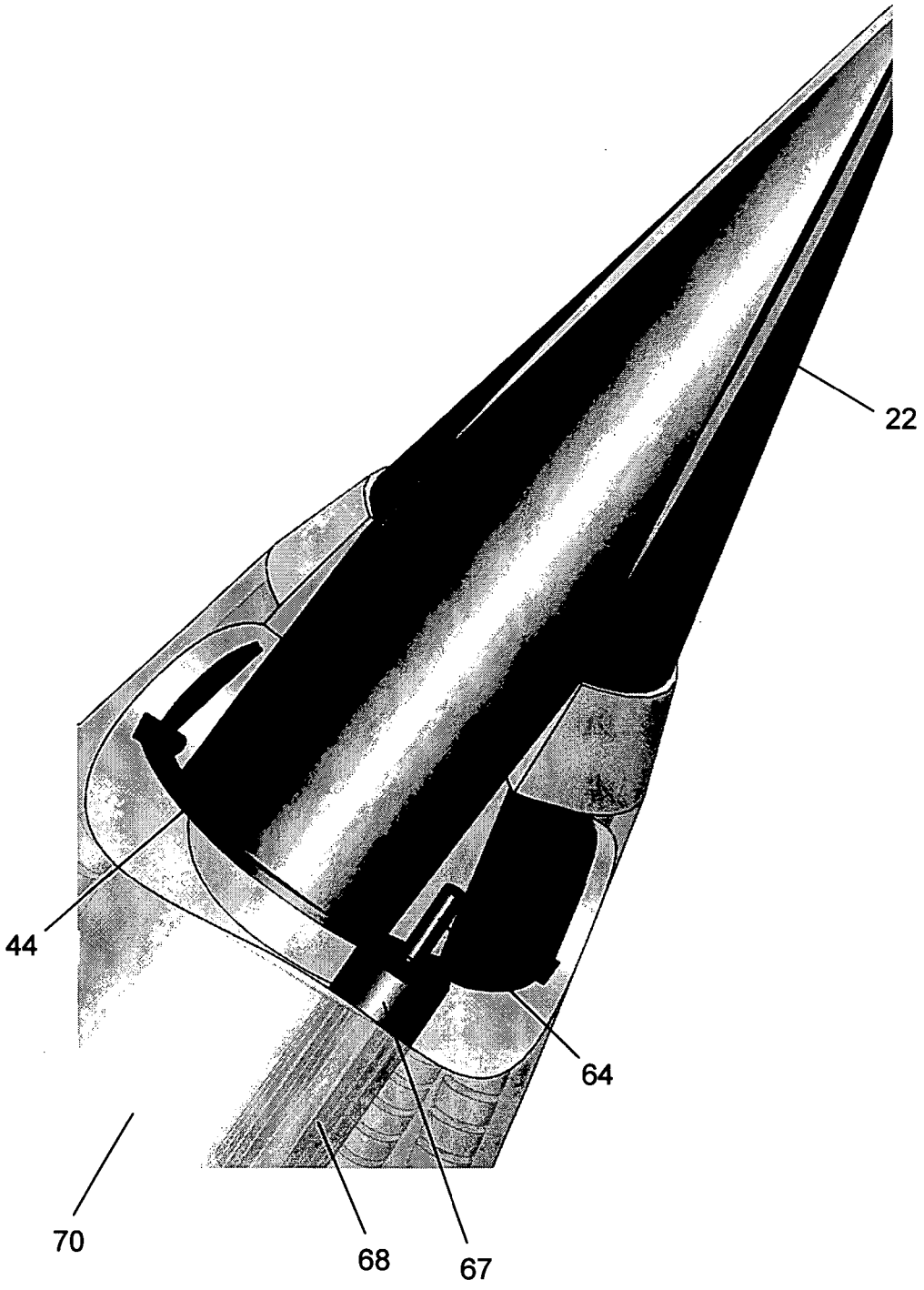
FIG. 12 a perspective view from the side of the missile nose fairing system of FIG. 7, showing a drive unit and an associated restraining pin while the missile nose body is partially removed.

As shown in FIG. 12, restraining pin 64 which is releasably securable to the walls of seat 46 (FIG. 8) of ring 44, may be axially displaceable within interior 67 of a cylinder 68 fixedly attached to missile body 70. Restraining pin 64 is received in seat 46 when it protrudes forwardly from cylinder 68, and ring 44 is compressed to allow the plurality of sections 22 to be retracted when pin 64 is withdrawn into cylinder 68. Restraining pin 64 may also be connected to a piston that is aftwardly displaceable within cylinder 68. Actuator 56 of drive unit 49 (FIG. 7), which may be electric, electronic, or pyrotechnic means, as well known to those skilled in the art, causes retraining pin 64 to be released from seat 46 following transmission of signal S to controller 56.

While some embodiments of the invention have been described by way of illustration, it will be apparent that the invention can be carried out with many modifications, variations and adaptations, and with the use of numerous equivalents or alternative solutions that are within the scope of persons skilled in the art without exceeding the scope of the claims.

The invention claimed is:

1. A missile nose fairing system, comprising:

a) a plurality of sections attached at an aft end thereof to a missile body, each of said sections having an outer surface that converges to a common forward pointed tip for enclosing and protecting a guidance head when in an extended position and being retractable into a corresponding recessed region formed within a missile nose;

b) restraining means for preventing aftward displacement of said plurality of sections; and c) a drive unit for releasing said restraining means in response to a received signal, thereby allowing said plurality of sections to be retracted into the corresponding recessed regions.

2. The nose fairing system according to claim 1, wherein the cross section of each section is an arc surrounding the longitudinal axis of the missile nose, the arc length of each section gradually decreasing from an aft edge of the section to the tip thereof.

3. The nose fairing system according to claim 2, wherein each recessed region is similarly configured as a corresponding section, an inner surface of a retracting section being slidable along an outer surface of a corresponding recessed region.

4. The nose fairing system according to claim 3, wherein each section is triangularly shaped.

5. The nose fairing system according to claim 4, wherein each section has two substantially parallel side edges extending from the aft edge and two converging side edges extending from said parallel edges, respectively, to the tip, a triangular opening being formed between the aft edge of two adjacent sections set in an extended position and leads to a junction between the adjacent converging side edges of said two adjacent sections.

6. The nose fairing system according to claim 5, wherein a plurality of recessed regions are formed in a surface of a missile nose assembly in which the guidance head is housed, said nose assembly comprising an annular aftwardly disposed base portion connected to the missile body and a forwardly disposed guide portion provided with the plurality of recessed regions, the aft edge of each of the sections in a completely retracted position adapted to abut a forward surface of the base portion.

7. The nose fairing system according to claim 6, wherein the guide portion comprises a plurality of identical circumferentially spaced and triangularly shaped dividers provided along an outer surface of the guide portion and extending forwardly from the base portion, and a surface which is recessed from said dividers and which extends from the base portion to a forward edge of the nose assembly being spaced forwardly from an apex of each of said dividers.

8. The nose fairing system according to claim 7, wherein a recessed region for receiving a corresponding retracting section is defined between a pair of adjacent dividers, and a circumferential distance along the recessed surface of each region between a first side edge of a first divider and a second side edge of a second divider which is adjacent to said first divider is substantially equal to the circumferential distance between the substantially parallel side edges of a section received in a corresponding recessed region.

9. The nose fairing system according to claim 8, wherein the nose assembly tapers such that the diameter of its forward edge is less than that of the base portion, the degree of tapering of the nose assembly being substantially equal to the degree of tapering of each retractable section.

10. The nose fairing system according to claim 6, wherein each section is attached to the missile body by means of one or more tension springs which are biased to draw the section aftwardly upon release of the restraining means.

11. The nose fairing system according to claim 10, wherein the restraining means comprises a longitudinally fixed and a transversally deformable ring configured such that the plurality of sections are allowed to be aftwardly displaced upon deformation of said ring.

12. The nose fairing system according to claim 11, wherein the ring is formed with a seat for receiving a displaceable restraining pin arranged such that deformation of the ring is prevented when said restraining pin is received in said seat.

13. The nose fairing system according to claim 12, wherein the restraining pin is associated with the drive unit which, when actuated, releases the pin from the seat, thereby allowing the ring to become deformed.

14. The nose fairing system according to claim 13, wherein the ring comprises two pivotable circumferential portions arranged such that the forward face of said two circumferential portions abuts the aft edge of each section in an extended position and ceases to abut the aft edge of each section following actuation of the drive unit and the pivotal displacement of said two circumferential portions.

15. The nose fairing system according to claim 14, wherein the ring comprises two parallel and concentric annular plates that define a groove therebetween arranged such that an end of a first circumferential portion is received in the groove of a second circumferential portion upon pivotal displacement of said first and second circumferential portions.

16. The nose fairing system according to claim 13, wherein the ring is compressible and made of a springy metal.

17. The nose fairing system according to claim 16, wherein each section in an extended position applies a radially inwardly directed force onto the ring so that, when the restraining pin is removed from the seat, portions of the ring are inwardly displaced and the sections are allowed to be aftwardly displaced.

18. The nose fairing system according to claim 11, wherein the ring is longitudinally fixed within a transversal channel formed in the missile nose assembly and extending between a recessed region and the guidance head, the width of said channel being substantially equal to the thickness of the ring.

19. The nose fairing system according to claim 13, wherein the drive unit has an actuator in communication with a controller, said controller adapted to activate said actuator in response to a transmitted signal.

20. The nose fairing system according to claim 19, wherein the drive unit comprises a cylinder fixedly attached to missile body and the restraining pin is axially displaceable within the interior of said cylinder.

21. The nose fairing system according to claim 20, wherein the actuator is selected from the group consisting of electric, electronic, pneumatic, or pyrotechnic means.

22. The nose fairing system according to claim 1, wherein the guidance head is an electro-optic guidance head.

* * * * *